US010062536B2

(12) United States Patent
Yamaguchi

(10) Patent No.: US 10,062,536 B2
(45) Date of Patent: Aug. 28, 2018

(54) FUSIBLE LINK UNIT

(71) Applicant: YAZAKI CORPORATION, Tokyo (JP)

(72) Inventor: Makoto Yamaguchi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 6 days.

(21) Appl. No.: 15/221,314

(22) Filed: Jul. 27, 2016

(65) Prior Publication Data

US 2017/0032919 A1 Feb. 2, 2017

(30) Foreign Application Priority Data

Jul. 30, 2015 (JP) ..... 2015-151036
Jul. 5, 2016 (JP) ..... 2016-133622

(51) Int. Cl.
*H01H 85/02* (2006.01)

(52) U.S. Cl.
CPC ... *H01H 85/0241* (2013.01); *H01H 2085/025* (2013.01); *H01H 2223/038* (2013.01)

(58) Field of Classification Search
CPC ..... H01H 85/0241; H01H 2223/038; H01H 2085/025
USPC ..... 337/142, 186
See application file for complete search history.

(56) References Cited

U.S. PATENT DOCUMENTS

2009/0251200 A1* 10/2009 Urrea ..... H01H 85/12 327/525
2012/0126929 A1* 5/2012 Tong ..... H01H 85/36 337/142
2012/0262267 A1* 10/2012 Nohara ..... H01H 85/044 337/186
2012/0286922 A1* 11/2012 Matsumoto ..... H01H 85/0078 337/206

FOREIGN PATENT DOCUMENTS

JP 2010-108783 A 5/2010
JP 2010199024 A * 9/2010

OTHER PUBLICATIONS

Matsumura Norio; Masuda Toshiko; Aoki Tatsuya, Fusible Link, Sep. 9, 2010, Yazaki Corp, Entire Document (Translation of JP 2010199024).*

* cited by examiner

*Primary Examiner* — Jerry Wu
*Assistant Examiner* — Stephen Sul
(74) *Attorney, Agent, or Firm* — Kenealy Vaidya LLP

(57) ABSTRACT

A fusible link unit includes: a fuse element including a plurality of fusible portions arrayed in a predetermined array direction; a housing having a window portion penetrating the housing in an intersecting direction to intersect the array direction; and fusible portion covers attached to the housing. The housing holds the fuse element to locate the fusible portions inside the window portion. The fusible portion covers includes a first cover that is transparent and has a plate shape extending in the array direction and covering one (Continued)

opening of the window portion and a second cover that is non-transparent and having a plate shape extending in the array direction and covering the other opening of the window portion. A length of the first cover in the array direction is different from a length of the second cover in the array direction.

5 Claims, 7 Drawing Sheets

FUSIBLE LINK UNIT

CROSS-REFERENCES TO RELATED APPLICATION(S)

This application is based on and claims priority from Japanese Patent Applications No. 2015-151036 filed on Jul. 30, 2015 and No. 2016-133622 filed on Jul. 5, 2016, and the entire contents of which are incorporated herein by reference.

BACKGROUND

Field of the Invention

This invention relates to a fusible link unit provided between a power source and a load (e.g., between an on-vehicle battery and various equipment).

Description of Related Art

Fusible link units (hereinafter referred to as fuse units) directly attached to an on-vehicle battery are conventionally known. Such a fusible link unit typically includes a housing made of insulating resin, and a fuse element(s) housed in the housing. The fuse element is a conductive member including a bus bar(s) connected to the on-vehicle battery, a fusible portion and a terminal, etc.). The fusible portion (a portion where a circuit breaks due to fusing) of each fuse element is configured to be broken due to fusing when a current beyond its rated current flows into the fuse element.

For example, one of conventional fusible link units (hereinafter referred to as a "conventional unit") has openings in a housing package. The openings are located correspondingly to fusible portions. The conventional unit also has openings in a slide-type cover to cover the housing package. The conventional unit allows users to visually recognize the fusible portions inside the housing through the both openings when the cover is slid to overlap the both openings each other.

As for details of the conventional unit, refer to JP 2010-108783 A.

SUMMARY

The conventional unit employs the slide-type cover to enable its openings (the openings of the housing) to be opened and closed to allow users to visually recognize the inside of the housing. However, a mechanism to achieve the movable cover (e.g., a mechanism for regulating a sliding direction, a mechanism for fixing the cover at a predetermined sliding position, etc.) has typically a complicated structure. This causes difficulty in reducing the manufacturing cost of the conventional unit.

It is an object of the present invention, in view of the above problems, to provide a fusible link unit to allow users to visually recognize its fusible portion of its fuse element, and to reduce its manufacturing cost as much as possible.

Fusible link units according to the invention include the following (1) to (5).

(1)

A fusible link unit comprising:

a fuse element including a plurality of fusible portions arrayed in a predetermined array direction;

a housing having a window portion penetrating the housing in an intersecting direction to intersect the array direction, the housing holding the fuse element to locate the fusible portions inside the window portion; and fusible portion covers attached to the housing, the fusible portion covers including a first cover being transparent and having a plate shape extending in the array direction and covering one opening of the window portion and a second cover being non-transparent and having a plate shape extending in the array direction and covering the other opening of the window portion, a length of the first cover in the array direction being different from a length of the second cover in the array direction.

(2)

The fusible link unit according to item (1), wherein the length of the first cover in the array direction is shorter than the length of the second cover in the array direction.

(3) The fusible link unit according to item (2), wherein the second cover is formed from fiber-reinforced resin and has locking portions provided at opposite ends in the array direction of the second cover to fix the second cover to the housing.

(4)

The fusible link unit according to any one of items (1) to (3), wherein the first cover has locking portions provided at opposite ends in the array direction of the first cover to fix the first cover to the housing;

the second cover has locking portions at opposite ends in the array direction of the second cover to fix the second cover to the housing; and the housing has locked regions near opposite ends of the window portion in the array direction, and the locked regions each include a locked portion corresponding to the locking portion of the first cover and a locked portion corresponding to the locking portion of the second cover, and the locked portions are adjacently located to each other.

(5)

The fusible link unit according to any one of items (1) to (4), wherein a distance between the first cover and the fusible portions in the intersecting direction is larger than a distance between the second cover and the fusible portion in the intersecting direction.

According to the fusible link unit of the item (1), the fusible portion cover (first cover) is transparent. Accordingly, the fusible portions of the fuse element are visually recognized through the first cover. Furthermore, since only one of the fusible portion covers (only the first cover) is transparent, the usage of a transparent material (such as transparent resin) that is generally more expensive than a non-transparent material is reduced, in comparison with a case where both the fusible portion covers (the first cover and the second cover) are transparent. In addition, since the first cover and the second cover are different in length in the array direction, the both are easily distinguished to enhance the working efficiency in attaching the fusible portion covers to the housing. Accordingly, the fusible link unit of this item allows users to visually recognize its fusible portion of its fuse element, and reduces its manufacturing cost as much as possible.

In addition, according to the conventional unit, a space to slide a cover is needed around the unit in principle. Consequently, when the conventional unit is attached to an on-vehicle battery etc., it is likely that the position where the unit is attached is limited. On the other hand, according to the fusible link unit of the above configuration, the fusible portions of the fuse element are visually recognized without using sliding covers. Thus, the fusible link unit according to the above configuration has higher degree of freedom as to the attachment position where the unit is attached to an on-vehicle battery etc. compared with the conventional unit.

According to the fusible link unit of the above item (2), the length of the transparent first cover is shorter than the length of the non-transparent second cover. Accordingly, the usage of a transparent material generally more expensive than a non-transparent material is reduced in comparison with a case where the lengths are reversed (That is, a case where the first cover is longer than the second cover). Thus, in the fusible link unit according to this configuration, the manufacturing cost is further reduced.

According to the fusible link unit of the above item (3), the non-transparent second cover is formed from fiber-reinforced resin. Accordingly, the strength of the second cover is enhanced and thus the locking portions of the second cover are more surely prevented from being damaged. On the other hand, while the enhanced strength of the second cover, the second cover is longer than the first cover (see the above configuration (2)) and thus the second cover is bent more easily than that in a case where the lengths of the first cover and the second cover are reversed. Accordingly, in the fusible link unit according to this configuration, it is possible to enhance the strength of the second cover while maintaining the workability in attaching the second cover to the housing. Furthermore, in the fusible link unit according to this configuration, internal stress caused by bending during the attachment is distributed to a wider range. Accordingly, the second cover is more surely prevented from being damaged during the attachment.

According to the fusible link unit of the above item (4), the locked portions corresponding to the locking portions of the first cover and the second cover are provided collectively in predetermined positions (locked regions) of the housing. Accordingly, a mold for molding the housing is simplified in comparison with a case where the locked portions are provided distantly from each other. Thus, in the fusible link unit according to this configuration, the manufacturing cost of the mold (and hence the manufacturing cost of the fusible link unit) is reduced.

According to the fusible link unit of the above item (5), the distance between the transparent first cover and each fusible portion is larger than the distance between the non-transparent second cover and the fusible portion. In other words, the first cover (transparent) is provided to be located more distantly from each fusible portion than the second cover (non-transparent). Accordingly, the influence of heat radiation from each fusible portion to the transparent material (first cover) generally poorer in heat resistance than the non-transparent material is reduced in comparison with a case where the distances are reversed (That is, a case where the first cover is closer to each fusible portion than the second cover). Thus, in the fusible link unit according to this configuration, the transparent first cover is more surely prevented from being deformed or discolored, so that the state in which the fusible portions are visually recognized from the outside is maintained for a long time.

According to the invention, the window portion of the housing is closed by the transparent first cover and the non-transparent second cover, so that the usage of an expensive transparent material is reduced while the fusible portions of the fuse element are visually recognized from the outside. Furthermore, the lengths of the first cover and the second cover are different in the array direction of the fusible portions. Accordingly, the covers are easily distinguished to enhance the working efficiency in attaching the covers to the housing.

The invention is briefly described above. Furthermore, some embodiments of the invention will be described below with some drawings to give clear details of the invention.

BRIEF DESCRIPTION OF THE DRAWINGS

FIG. 2A is a perspective view in which the same unit is observed from the front, and FIG. 2B is a perspective view in which the same unit is observed from the back.

FIG. 3A is a front view in which the same unit is observed from the front, and FIG. 3B is a back view in which the same unit is observed from the back.

DETAILED DESCRIPTION

A fusible link unit 1 according to an embodiment of the invention will be described below with reference to FIG. 1 to FIG. 6.

Figure 1:
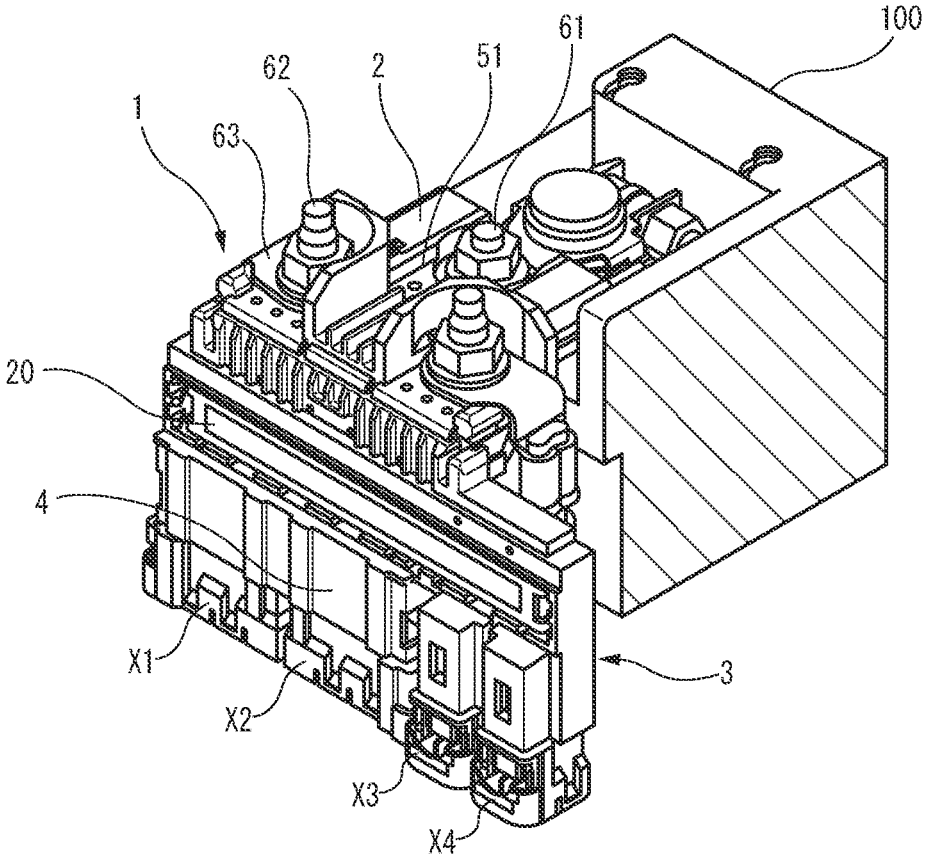
FIG. 1 is a perspective view illustrating a use state of a fusible link unit according to an embodiment of the invention.
Figure 2A:
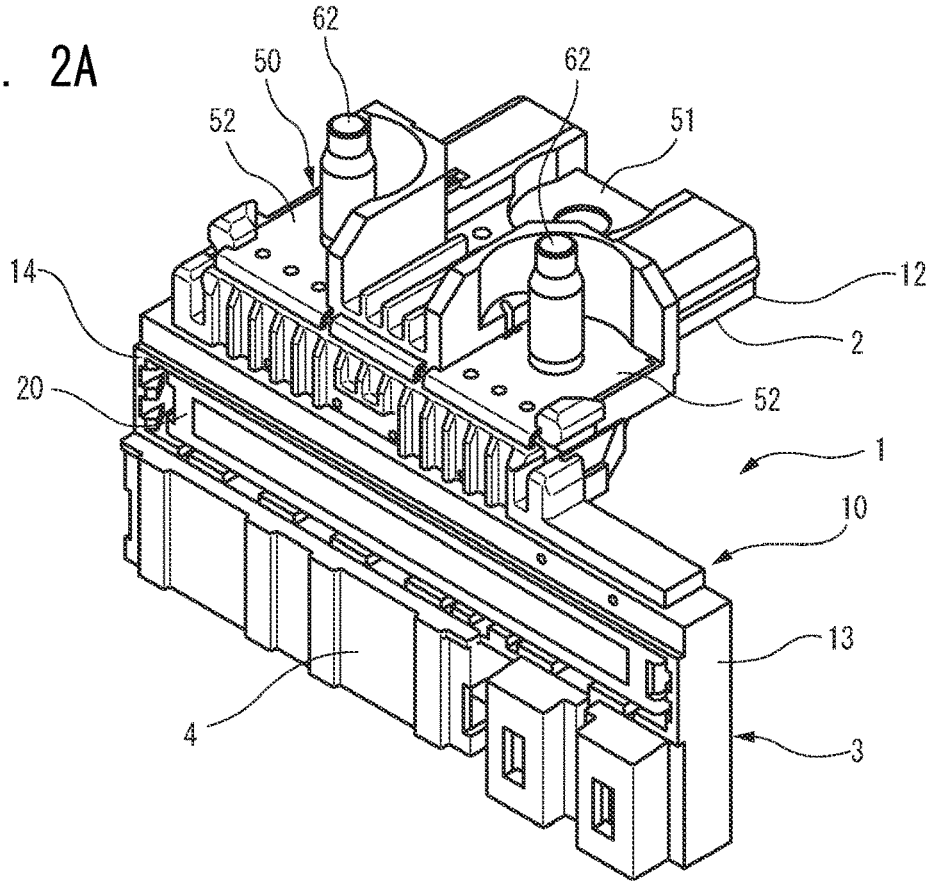
FIGS. 2A and 2B are configuration views of the fusible link unit in FIG. 1.
Figure 2B:
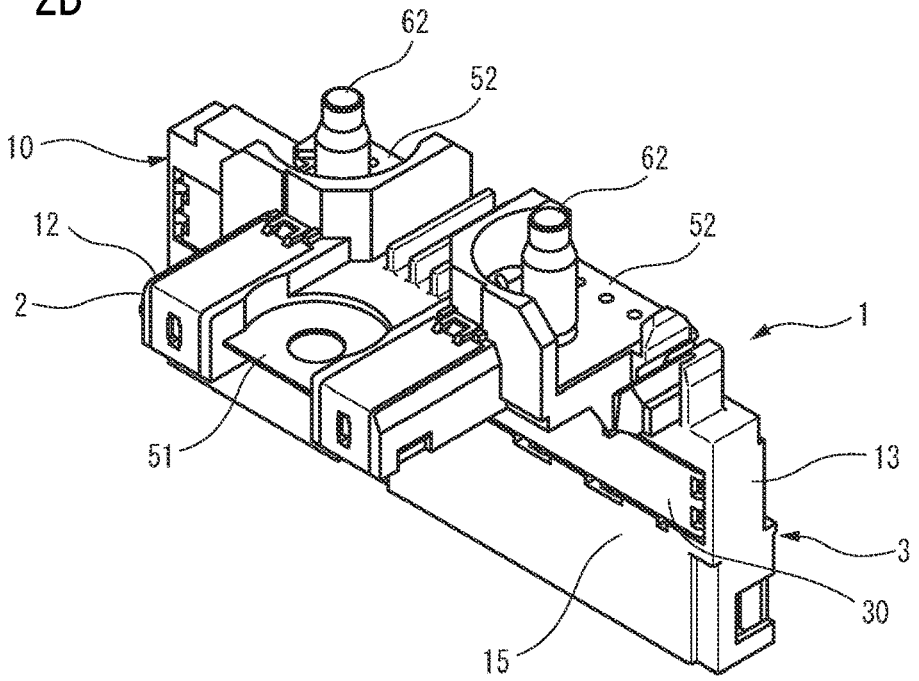
Figure 3A:
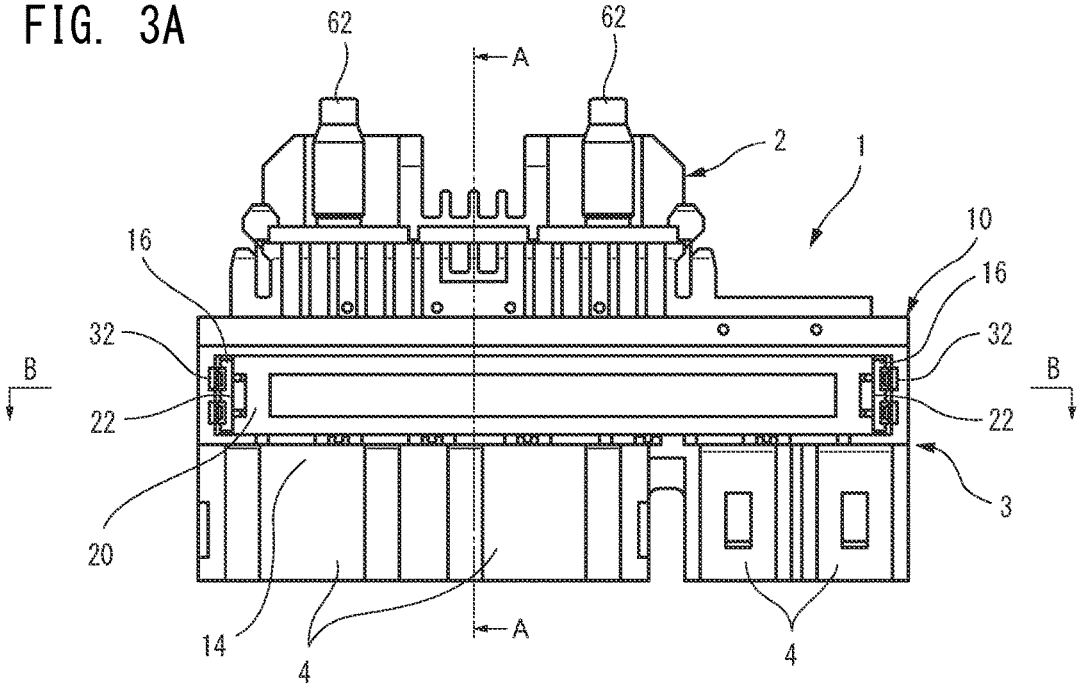
FIGS. 3A and 3B are configuration views of the fusible link unit in FIG. 1.
Figure 3B:
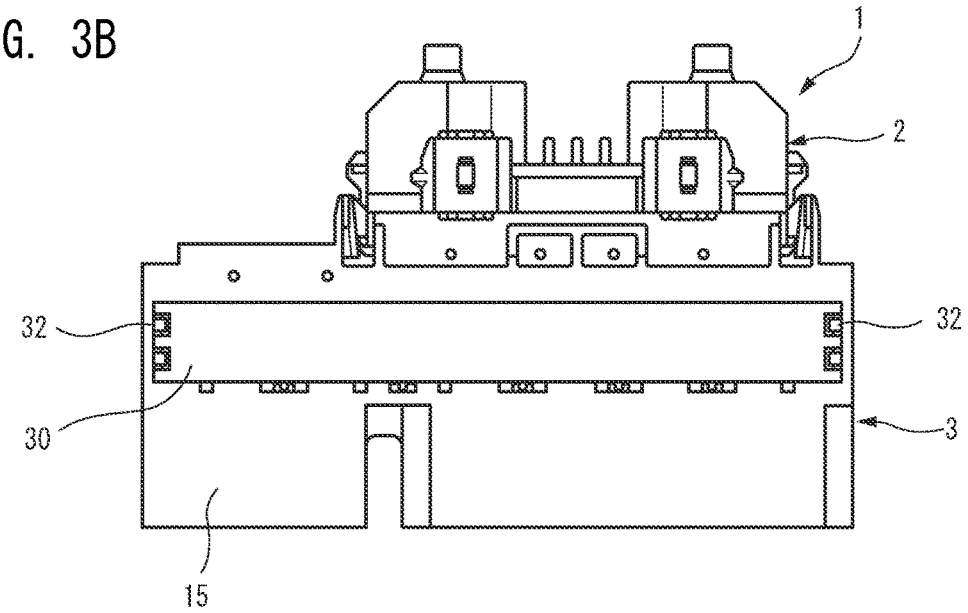

As illustrated in FIG. 1, the fusible link unit 1 is directly attached to a battery 100 to be mounted on a car etc. when the fusible link unit 1 is used. The fusible link unit 1 has a horizontal block portion 2 disposed on the upper surface side of the battery 100, and a vertical block portion 3 suspended from an edge of the horizontal block portion 2 and disposed on the side surface side of the battery 100. In a lower end portion of the vertical block portion 3, connector portions 4 to connect connectors X1 to X4 (not illustrated) are disposed laterally in a line (in a line in a left/right direction from the front). The connectors are attached to ends of electric wires (not illustrated) connected to loads. The left/right direction will be also referred to as "array direction". Furthermore, a direction (a front/rear direction of each connector portion 4) intersecting the array direction at right angles will be also referred to as "intersecting direction".

In addition, connecting the connectors X1 to X4 to the vertical block portion 3 of this embodiment allows terminal portions 53 (see FIG. 4) housed inside of the vertical block portion 3 and terminal portions (not illustrated) housed in the connectors X1 to X4 to be electrically connected. However, the method for electrically connecting the both is not limited to this method. For example, the both may be electrically connected by fixing the terminal portions 53 (see FIG. 4) housed inside of the vertical block portion 3 and the terminal portions housed in the connectors X1 to X4 with bolts and nuts.

As illustrated in FIG. 2, the fusible link unit 1 has a housing 10 made of insulating resin, and a fuse element 50 (bus bar). Main portions of the fuse element 50 are embedded inside the housing 10 in a state where terminal portions 51 and 52 on the power source side and a plurality of terminal portions 53 (see FIG. 4) on the load side are exposed to the outside. In addition, as illustrated in FIG. 1, terminals connected to battery posts are connected to the terminal portions 51 on the power source side by using fastening bolts 61, and terminals 63 connected to an alternator etc. are connected to the other terminal portions 52 on the power source side by using fastening bolts 62, etc.

Each fuse element 50 (bus bar) has a circuit structure formed by punching a metal plate. In the state where the fuse element 50 has been set in a mold, the housing 10 is formed by insert molding. Thus, the fuse element 50 is integrated with the housing 10. On the housing 10 side, a part corresponding to the horizontal block portion 2 is formed into a horizontal plate-like portion 12. On the housing 10 side, a part corresponding to the vertical block portion 3 is formed into a wall portion 13. The wall portion 13 has a thickness in the front/rear direction (which is the same as the intersecting direction in this example), and is formed into a rectangular shape in view from the front.

A plurality of fuses 55 (see FIG. 6) are formed integrally with the fuse element 50. The terminal portions 51 and 52 on the power source side and the terminal portions 53 on the load side are connected through the fuses 55 respectively. The fuses 55 (in particular, fusible portions 56) are disposed to be arrayed in the above array direction (in this example, the left/right direction when the fusible link unit 1 is observed from the front). The fuses 55 are housed in the wall portion 13 of the housing 10 constituting the vertical block 3. The terminal portions 53 on the load side are provided as connector terminals in the connector portions 4 at the lower end of the vertical block portion 3, so as to be located below the fuses 55.

Figure 4:
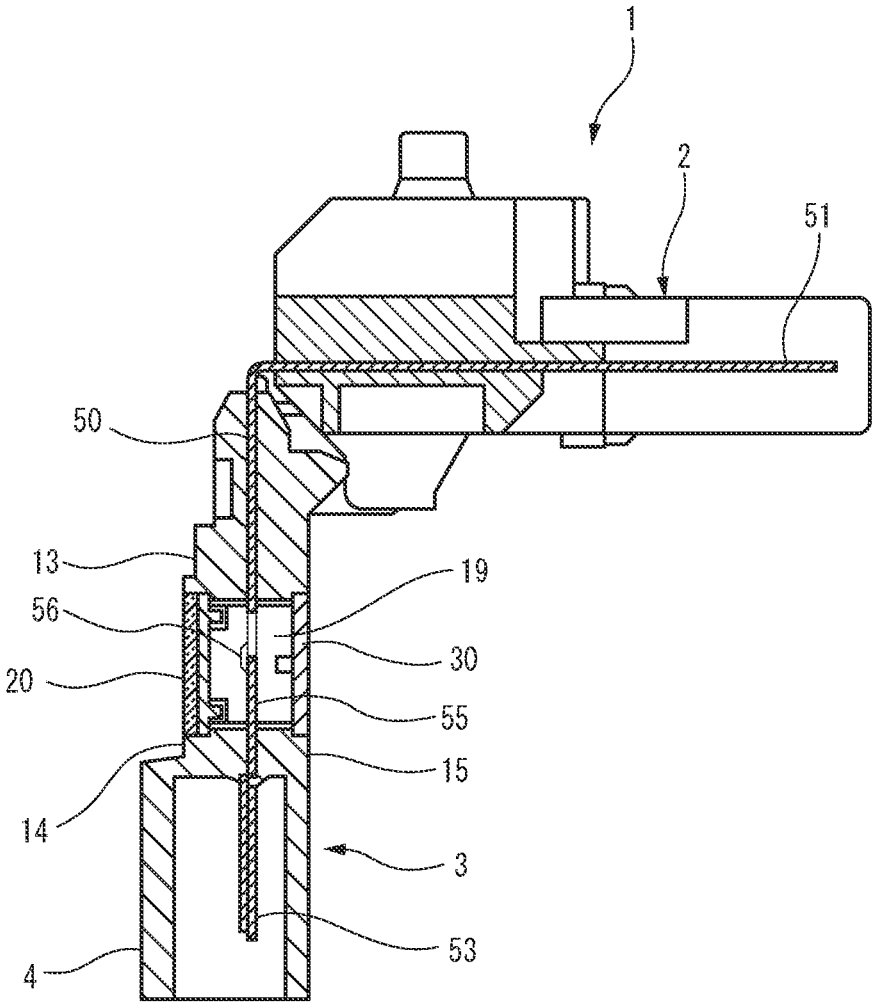
FIG. 4 is a sectional view taken on line A-A in FIG. 3A.
Figure 6:
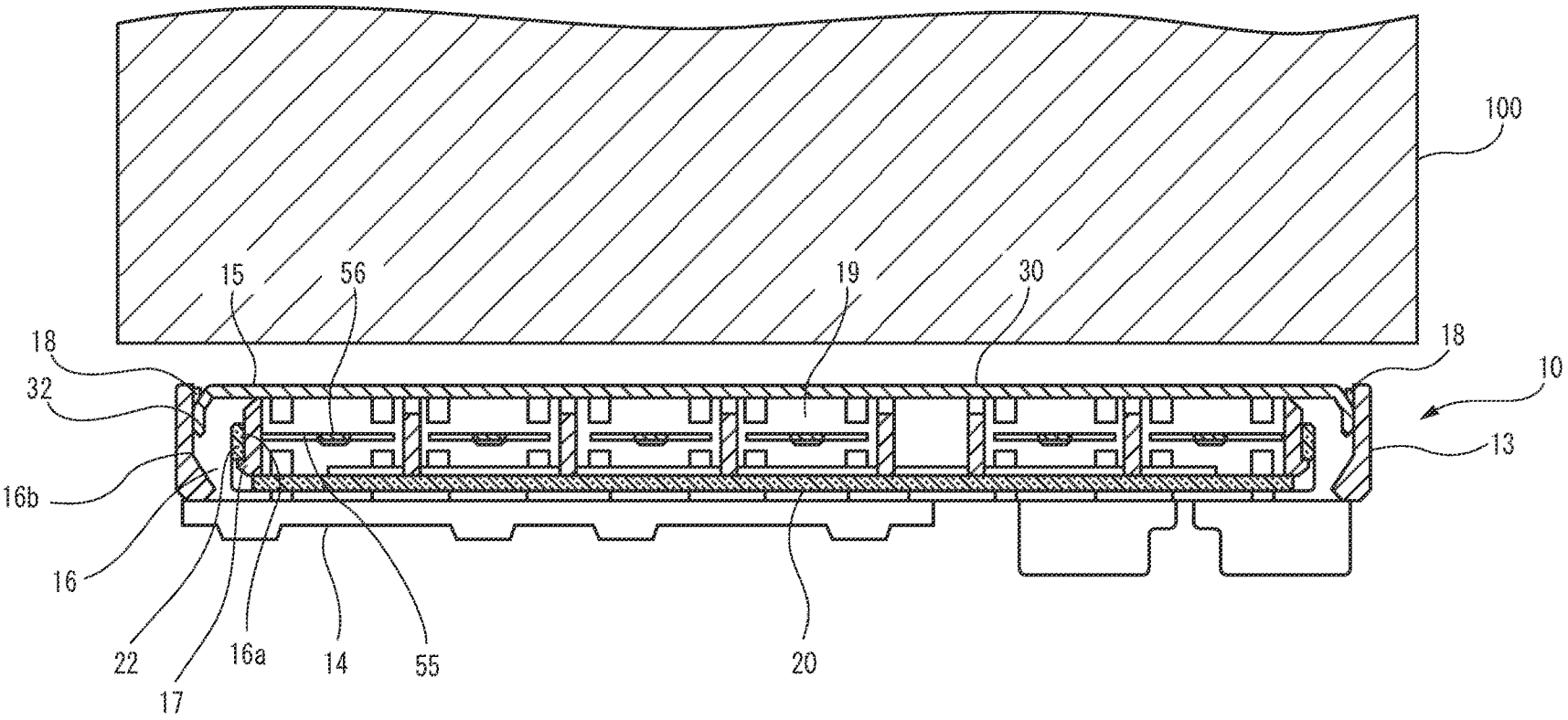
FIG. 6 is a sectional view taken on line B-B in FIG. 3A.

As illustrated in FIG. 4 and FIG. 6, a window portion 19 is provided in the wall portion 13 of the housing 10 receiving the fuses 55. The window portion 19 penetrates the wall portion 13 from a front wall surface 14 to a rear wall surface 15. In other words, the window portion 19 is provided to penetrate the housing 10 in an intersecting direction (in this example, the front/rear direction when the fusible link unit 1 is observed from the front) intersecting the array direction of the fuses 55 (fusible portions 56). In particular, the window portion 19 is provided as a plurality of through holes arrayed in the array direction (left/right direction) of the fuses 55 (fusible portions 56).

The fusible portions 56 (fusible portions) of the fuses 55 are respectively housed inside the through holes of the window portion 19 (also see FIG. 6). That is, the housing 10 houses the fuse element 50 so that the fusible portions 56 of the fuses 55 are exposed in the window portion 19.

In the front surface of the window portion 19, a front cover 20 (transparent first cover) made of transparent resin is attached to the housing 10 so as to close an opening 14*a* on the front surface side of the window portion 19. The front cover 20 is formed into a plate-like shape long from side to side (i.e., a plate-like shape extending in the array direction of the fusible portions 56) correspondingly to the shape of the opening 14*a* on the front surface side of the window portion 19. Since the front cover 20 is transparent, the fusible portions 56 of the fuses 55 are covered with the front cover 20 to allow users to visually recognize the fusible portions 56 from their external front sides. For example, a resin material that is transparent and has heat resistance (such as PESU, PAR, etc.) may be used as the material of the front cover 20. In addition, such a transparent resin material is generally more expensive than a non-transparent resin material, which will be described later.

In the rear surface of the window portion 19, a rear cover 30 (non-transparent second cover) made of non-transparent resin is attached to the housing 10 so as to close an opening 15*a* on the rear surface side of the window portion 19. The rear cover 30 is also formed into a plate-like shape long from side to side (That is, a plate-like shape extending in the array direction of the fusible portions 56) correspondingly to the shape of the opening 15*a* on the rear surface side of the window portion 19. A resin material that is non-transparent and contains glass fiber superior in strength and heat resistance (such as PS-S, PA6T, etc. reinforced with fiber) may be used as the material of the rear cover 30. In addition, a material containing reinforcing fiber (such as carbon fiber) other than the glass fiber may be used as the material of the rear cover 30.

The configurations of the front cover 20 and the rear cover 30 will be described below in detail with reference to FIG. 5 and FIG. 6.

Figure 5A:
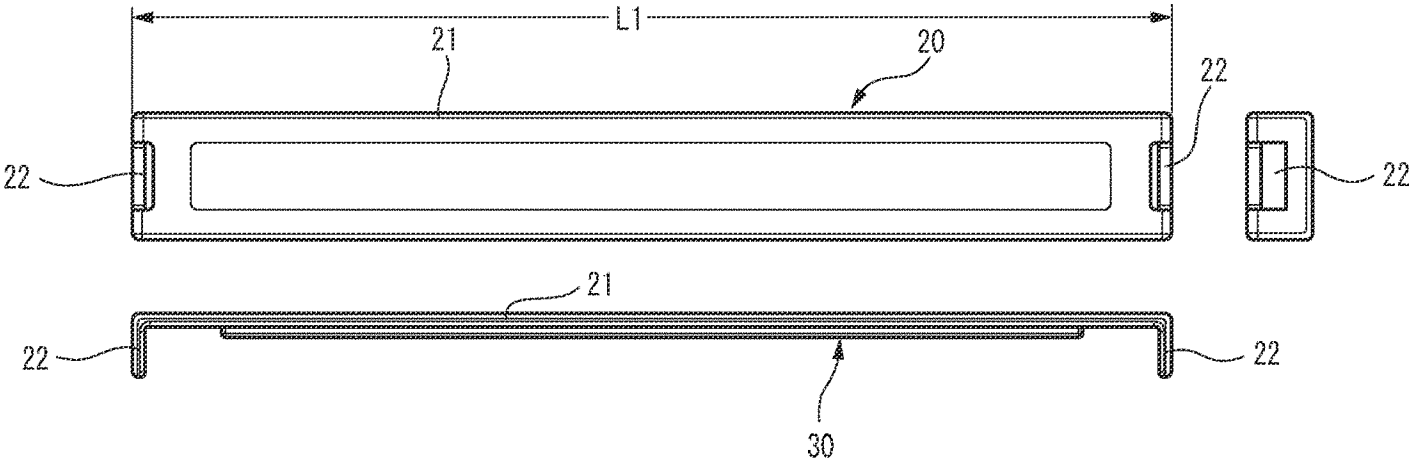
FIG. 5A is a three-plane view of a front cover made of transparent resin.

As illustrated in FIG. 5A, in the transparent front cover 20, longitudinally opposite ends (opposite ends in the above array direction) of a body portion 21 like a plate large enough to close the opening 14*a* (see FIG. 2A, FIG. 3A and FIG. 4) on the front surface side of the window portion 19 are shaped to be bent in a direction perpendicular to the plate surface of the body portion 21. First locking portions 22 are formed at the opposite ends of the front cover 20. The first locking portions 22 are locking portions for fixing the front cover 20 to the housing 10 when the front cover 20 is attached to the housing 10 (in particular, the opening 14*a* on the front surface side of the window portion 19).

Figure 5B:
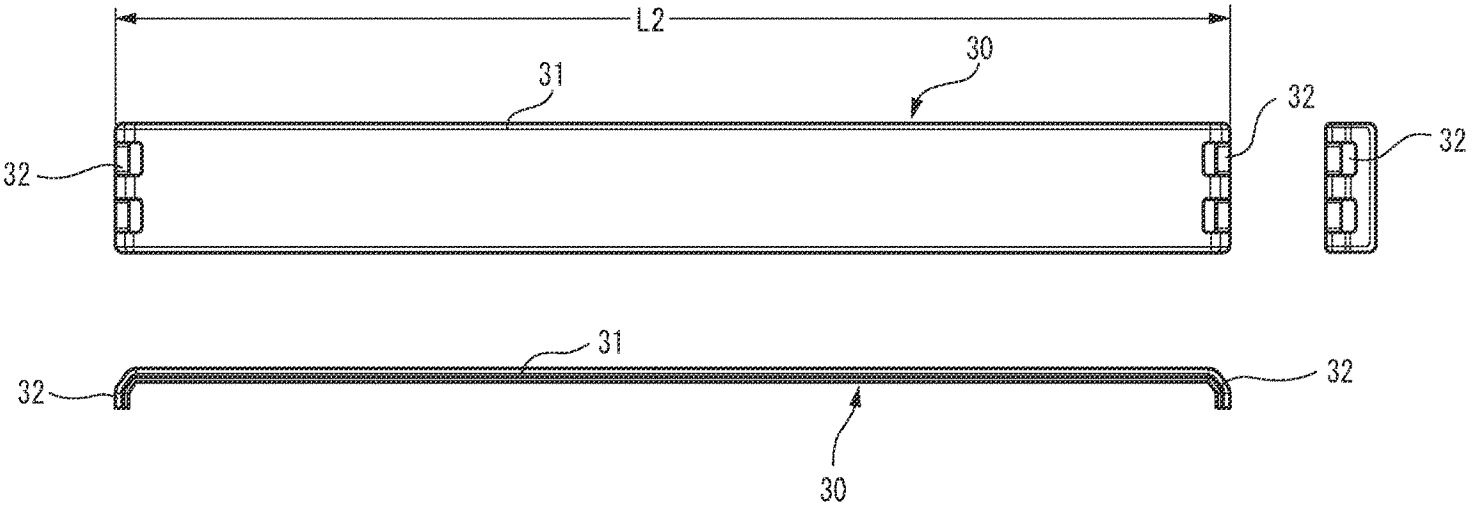
FIG. 5B is a three-plane view of a rear cover made of non-transparent resin.

As illustrated in FIG. 5B, in the non-transparent rear cover 30, longitudinally opposite ends (opposite ends in the above array direction) of a body portion 31 like a plate large enough to close the opening 15*a* (see FIG. 2B, FIG. 3B and FIG. 4) on the rear surface side of the window portion 19 are shaped to be bent in a direction perpendicular to the plate surface of the body portion 31. Second locking portions 32 are formed at the opposite ends of the rear cover 30. The second locking portions 32 are locking portions for fixing the rear cover 30 to the housing 10 when the rear cover 30 is attached to the housing 10 (in particular, the opening 15*a* on the rear surface side of the window portion 19).

There is a difference between length L1 of the front cover 20 in the above array direction and length L2 of the rear cover 30 in the array direction. In particular, the length L1 of the front cover 20 in the array direction is shorter than the length L2 of the rear cover 30 in the array direction (L1<L2).

As a mating configuration to which the locking portions 22 and 32 are fixed, as illustrated in FIG. 6, first locked portions 17 to engage with the first locking portions 22 of the front cover 20, and second locked portions 18 to engage with the second locking portions 32 of the rear cover 30 are provided in the wall portion 13 of the housing 10 adjacently to each other near the opposite ends of the window portion 19 in the array direction, In other words, the first locked portions 17 and the second locked portions 18 are provided in locked regions 16 formed near the opposite end portions of the window portion 19.

In other words, each first locked portion 17 and each second locked portion 18 are provided in wall surfaces opposed to each other, and a region between the first locked portion 17 and the second locked portion 18 corresponds to a locked region 16. Each locked region 16 penetrates the housing 10 from the front wall surface 14 to the rear wall surface 15.

When the front cover 20 and the rear cover 30 are attached to the housing 10, each of the first locking portions 22 at the opposite ends of the front cover 20 engages with a corresponding one of the first locked portions 17 (two left and right first locked portions) so as to hold an inner side surface 16*a* on the inner side of a corresponding one of the locked regions 16 therebetween. Thus, the front cover 20 is fixed to the housing 10. On the other hand, each of the second locking portions 32 at the opposite ends of the rear cover 30 engages with a corresponding one of the second locked portions 18 (two left and right first locked portions) so as to press an inner side surface 16*b* on the outer side of a corresponding one of the locked regions 16 therebetween. Thus, the rear cover 30 is fixed to the housing 10.

According to the above configuration, due to the transparency of the front cover 20, the fusible portions 56 of the fuse element 50 are visually recognized from the outside through the front cover 20. Furthermore, since only the front cover 20 is transparent, the usage of an expensive transparent material is reduced in comparison with a case where both the front cover 20 and the rear cover 30 are transparent. In addition, due to a difference in length between the front cover 20 and the rear cover 30, the both are distinguished easily to enhance the working efficiency in attaching the covers to the housing 10. Accordingly, the fusible link unit 1 allows users to visually recognize the fusible portions 56 from the outside while reducing its manufacturing cost as much as possible.

The conventional unit needs a space to slide a cover around the unit in principle. Consequently, when the conventional unit is attached to an on-vehicle battery etc., it is likely that the position where the unit is attached is limited. On the other hand, in the fusible link unit 1 according to the above configuration, the fusible portions 56 of the fuse element 50 are visually recognized without sliding any cover. Accordingly, in the fusible link unit 1 according to the above configuration, the degree of freedom as to the position where the unit is attached to an on-vehicle battery is higher than that in the conventional unit.

Furthermore, the length of the transparent front cover 20 is shorter than the length of the non-transparent rear cover 30. Accordingly, the usage of the expensive transparent material is reduced in comparison with a case where the lengths are reversed (That is, a case where the front cover 20 is longer than the rear cover 30). Thus, the manufacturing cost of the fusible link unit 1 is further reduced.

Furthermore, since the non-transparent rear cover 30 is formed out of fiber-reinforced resin, the strength of the rear cover 30 is enhanced. In particular, the locking portions of the rear cover 30 are more surely prevented from being damaged. On the other hand, due to the enhanced strength, the rear cover 30 is hardly bent. However, since the rear cover 30 is longer than the front cover 20, the rear cover 30 is bent more easily than that in the case where the lengths are reversed. Accordingly, in the fusible link unit 1, it is possible to enhance the strength of the rear cover 30 while maintaining the workability in attaching the rear cover 30 to the housing 10. Furthermore, in the fusible link unit 1, internal stress caused by bending during the attachment is distributed to a wider range. Accordingly, the rear cover 30 is more surely prevented from being damaged during the attachment.

Furthermore, the locked portions 17 and 18 corresponding to the locking portions of the front cover 20 and the rear cover 30 are provided collectively in predetermined positions (locked regions 16) of the housing 10. Accordingly, a mold for molding the housing 10 is simplified in comparison with a case where the locked portions 17 and 18 are provided distantly from each other. Thus, in the fusible link unit 1, the manufacturing cost of the mold (and hence the manufacturing cost of the fusible link unit 1) is reduced.

In addition, the invention is not limited to the above embodiment, but modifications, improvements, and so on may be made thereon suitably. In addition, materials, shapes, dimensions, numbers, arrangement places, etc. of respective constituent members in the above embodiment are not limited, but each constituent member may have any material, any shape, any dimensions, any number, any arrangement place, etc. as long as the invention can be carried out.

Figure 7:
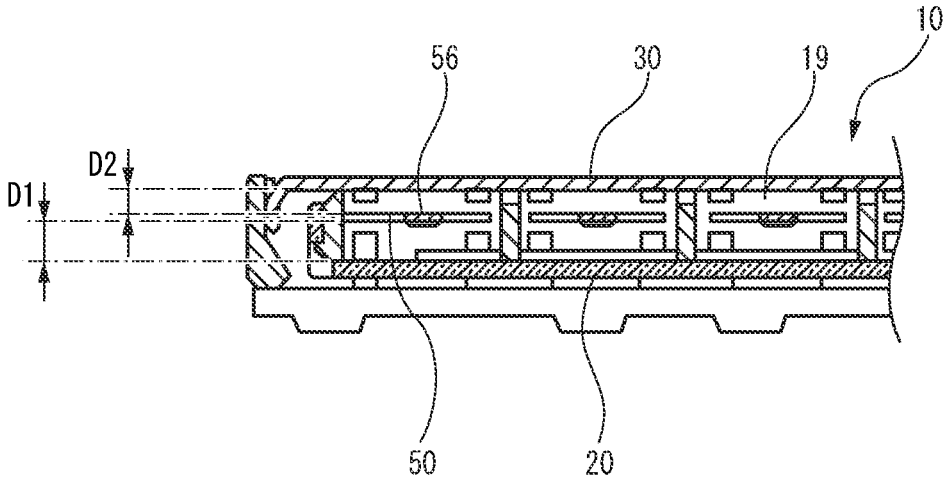
FIG. 7 is a sectional view (partially enlarged view) corresponding to FIG. 3A and illustrating a fusible link unit according to another embodiment of the invention.

For example, in the fusible link unit 1 according to the above embodiment, the front cover 20 and the rear cover 30 are arranged to have almost the same distance from each fuse element 50 (That is, each bus bar, in particular each fusible portion 56) in the intersecting direction. However, as illustrated in FIG. 7, a distance D1 between the front cover 20 and the fuse element 50 (fusible portion 56) in the intersecting direction may be designed to be longer than a distance D2 between the rear cover 30 and the fuse element 50 (fusible portion 56) in the intersecting direction (That is, D1>D2).

Due to the above configuration, the front cover 20 is provided to be located more distantly from each fusible portion 56 than the rear cover 30. Accordingly, the influence of heat radiation from each fusible portion 56 to the transparent material (front cover 20) generally poorer in heat resistance than the non-transparent material is reduced in comparison with a case where the distances are reversed (That is, a case where the front cover 20 is closer to the fusible portion 56 than the rear cover 30). Thus, the transparent front cover 20 is more surely prevented from being deformed or discolored, so that the state in which the fusible portions 56 are visually recognized from the outside is maintained for a long time.

In other words, for example, when the distance between the front cover 20 and each fusible portion 56 is the same as that in the above embodiment, the distance between the rear cover 30 and the fusible portion 56 is reduced, and thus the thickness of the housing 10 in the intersecting direction is reduced. Accordingly, the housing 10 (and hence the fusible link unit 1) is downsized.

Here, the characteristics of the above embodiment of the fusible link unit of the invention are described briefly as the following item (1) to (5).

(1)

A fusible link unit (1) comprising:

a fuse element (50) including a plurality of fusible portions (56) arrayed in a predetermined array direction;

a housing (10) having a window portion (19) penetrating the housing (10) in an intersecting direction to intersect the array direction, the housing (10) holding the fuse element (50) to locate the fusible portions (56) inside the window portion (19); and fusible portion covers (20, 30) attached to the housing (10), the fusible portion covers (20, 30) including a first cover (20) being transparent and having a plate shape extending in the array direction and covering one opening of the window portion (19) and a second cover (30) being non-transparent and having a plate shape extending in the array direction and covering the other opening of the window portion (19), a length (L1) of the first cover (20) in the array direction being different from a length (L2) of the second cover (30) in the array direction.

(2)

The fusible link unit (1) according to item (1), wherein the length (L1) of the first cover (20) in the array direction is shorter than the length (L2) of the second cover (30) in the array direction.

(3)

The fusible link unit (1) according to item (2), wherein the second cover (30) is formed from fiber-reinforced resin and has locking portions (32) provided at opposite ends in the array direction of the second cover (30) to fix the second cover (30) to the housing (10).

(4)

The fusible link unit (1) according to any one of items (1) to (3), wherein the first cover (20) has locking portions (22) provided at opposite ends in the array direction of the first cover (20) to fix the first cover (20) to the housing (10);

the second cover (30) has locking portions (32) at opposite ends in the array direction of the second cover (30) to fix the second cover (30) to the housing (10); and the housing (10) has locked regions (16) near opposite ends of the window portion (19) in the array direction, and the locked regions (16) each include a locked portion (17) corresponding to the locking portion (22) of the first cover (20) and a locked portion (18) corresponding to the locking portion (32) of the second cover (30), and the locked portions (17, 18) are adjacently located to each other.

(5)

The fusible link unit according to any one of items (1) to (4), wherein a distance (D1) between the first cover (20) and the fusible portions (56) in the intersecting direction is larger than a distance (D2) between the second cover (20) and the fusible portion (56) in the intersecting direction.

REFERENCE SIGNS LIST

1 fusible link unit
10 housing
13 wall portion
14 front wall surface
14*a* opening on front surface side
15 rear wall surface
15*a* opening on rear surface side
16 locked region
16*a* inner side surface on inner side
16*b* inner side surface on outer side
17 first locking portion
18 second locking portion
19 window portion
20 front cover (transparent cover, fusible portion cover)
22 first locking portion
30 rear cover (non-transparent cover, fusible portion cover)
32 second locking portion
50 fuse element
55 fuse
56 fusible portion
L1 length of front cover
L2 length of rear cover
D1 distance between front cover and fusible portion (bus bar)
D2 distance between rear cover and fusible portion (bus bar)

The invention claimed is:

1. A fusible link unit, comprising:

a fuse element including a plurality of fusible portions arrayed in a predetermined array direction;

a housing having a window portion penetrating the housing in an intersecting direction to intersect the array direction, the housing holding the fuse element to locate the fusible portions inside the window portion; and fusible portion covers attached to the housing, the fusible portion covers including a first cover being transparent and having a plate shape extending in the array direction and covering one opening of the window portion and a second cover being non-transparent and having a plate shape extending in the array direction and covering the other opening of the window portion, a length of the first cover in the array direction being different from a length of the second cover in the array direction, the first cover has locking portions provided at opposite ends in the array direction of the first cover to fix the first cover to the housing, the second cover has locking portions at opposite ends in the array direction of the second cover to fix the second cover to the housing, and the housing has locked regions near opposite ends of the window portion in the array direction, and the locked regions each include a locked portion corresponding to the locking portion of the first cover and a locked portion corresponding to the locking portion of the second cover, and the locked portions are adjacently located to each other, the locking portions of the first cover engage with the locked portions so as to hold an inner side surface on an inner side of a corresponding one of the locked regions therebetween, and the locking portions of the second cover engage with the locked portions so as to press an inner side surface on the outer side of a corresponding one of the locked regions therebetween.

2. The fusible link unit according to claim 1, wherein the length of the first cover in the array direction is shorter than the length of the second cover in the array direction.

3. The fusible link unit according to claim 2, wherein the second cover is formed from fiber-reinforced resin and has locking portions provided at opposite ends in the array direction of the second cover to fix the second cover to the housing.

4. The fusible link unit according to claim 1, wherein a distance between the first cover and the fusible portions in the intersecting direction is larger than a distance between the second cover and the fusible portions in the intersecting direction.

5. The fusible link unit according to claim claim 1, wherein the locked portion corresponding to the locking portion of the first cover is located on a first wall surface of the housing and the locked portion corresponding to the locking portion of the second cover is located on a second wall surface that opposes the first wall surface.

* * * * *